United States Patent [19]

Brackmann et al.

[11] 4,135,615

[45] Jan. 23, 1979

[54] TOBACCO FEEDING SYSTEM

[75] Inventors: Warren A. Brackmann, Cooksville; Karel Hrboticky, Etobicoke, both of Canada

[73] Assignee: Rothmans of Pall Mall Canada Limited, Toronto, Canada

[21] Appl. No.: 732,382

[22] Filed: Oct. 14, 1976

[30] Foreign Application Priority Data

Oct. 16, 1975 [GB] United Kingdom ..... 42574/75

[51] Int. Cl.[2] ..... B65G 37/00

[52] U.S. Cl. ..... 198/371; 198/436; 198/441; 198/569; 198/601; 131/108

[58] Field of Search ..... 198/358, 359, 362, 363, 198/371, 436, 437, 440, 441, 445, 524, 565, 568, 569, 601; 214/16 R, 17 CA; 222/56, 63, 64, 142, 159, 238, 272, 281, 367, 345, 349, 368, 330, 363; 221/10, 68, 174, 155; 131/21 R, 21 A, 25, 26, 108, 109 R

[56] References Cited

U.S. PATENT DOCUMENTS

| | | | |
|---|---|---|---|
| 748,549 | 12/1903 | White | 222/238 |
| 2,083,094 | 6/1937 | Rose | 222/349 |
| 2,785,683 | 3/1957 | Davidson | 198/601 |
| 2,827,058 | 3/1958 | Bogaty | 131/108 |
| 3,365,083 | 1/1968 | Baumann et al. | 198/358 |
| 3,613,953 | 10/1971 | Paules | 222/56 |
| 3,638,778 | 2/1972 | Remensperger | 198/437 |
| 3,715,041 | 2/1973 | Peters | 214/17 CA |

FOREIGN PATENT DOCUMENTS

| | | | |
|---|---|---|---|
| 796246 | 6/1958 | United Kingdom | 131/108 |

*Primary Examiner*—Joseph E. Valenza
*Attorney, Agent, or Firm*—Sim & McBurney

[57] ABSTRACT

A tobacco feeding system for feeding tobacco from a source thereof to a plurality of individual cigarette-making machines includes a tobacco distribution system for the distribution of source tobacco sequentially to a plurality of tobacco reservoirs and a tobacco metering system associated with each reservoir for feed of tobacco to the machine feeds. The system avoids the necessity to recycle tobacco to the source and hence minimizes tobacco degradation.

7 Claims, 6 Drawing Figures

TOBACCO FEEDING SYSTEM

FIELD OF INVENTION

This invention relates to a tobacco feeding system.

BACKGROUND TO THE INVENTION

In the making of cigarettes, tobacco from a single source is distributed to a plurality of cigarette-making machines. In one prior art system, tobacco is distributed from a hopper as a wide band on a generally horizontal conveyor belt. A plurality of suction tubes, one for each cigarette-making machine, is arranged adjacent the conveyor belt to draw the individual tobacco feeds from the wide band.

This prior art system operates satisfactorily provided that all the cigarette makers are operational. However, this is an unusual condition, and at least a number of cigarette makers may be inoperational at any one time, due to a variety of factors, so that the individual feeds of tobacco from the belt are not required for the inoperational machines. Nevertheless, the conveyor belt must still run at the same speed to provide the required feed for the operational machines.

Therefore, at any given time, a considerable quantity of tobacco, representing the quantity of feed not fed to the inoperational machines, is required to be recycled to the hopper. It is known that any handling and processing of tobacco causes degradation in the quality of the tobacco, measured in terms of its "filling power" that is, the ability of the tobacco to fill a cigarette tube. For a given hardness of cigarette, more tobacco of lower filling power is required than less tobacco of greater filling power.

The more manipulation of the tobacco which occurs, the greater is the degradation of the tobacco. In the prior art tobacco feeding system discussed above, except in rare instances where all the cigarette-making machines are operational, the tobacco ultimately used in the cigarette-making machines is of variable quality below that of the original tobacco due to the degradation of the tobacco on recycle and the varying quantity of tobacco involved in such recycle.

Another prior art system of tobacco feeding uses a conveyor belt arranged with a steep incline upwardly from a hopper to carry a broad band of tobacco on the conveyor belt. A paddle wheel is arranged adjacent the inclined conveyor to return tobacco above a predetermined quantity to the hopper, so that again there is recycling of tobacco and hence degradation of the tobacco. At the top of the incline the tobacco is allowed to fall and then abruptly changes direction and is simultaneously split into separate feeds for a plurality of cigarette-making machines. The abrupt change in direction of the tobacco and splitting the tobacco into a plurality of streams provides the opportunity for tobacco classification, since the shorts tend to accumulate adjacent the belt. Uneven tobacco quality thereby results.

SUMMARY OF INVENTION

In accordance with the present invention, there is provided a tobacco feeding system for the feeding of tobacco from a single source to a plurality of cigarette-making machines which avoids recycling of tobacco and abrupt changes in direction. Hence, the degradation of the filling power and classification of tobacco particle sizes introduced by the prior art devices is overcome by the present invention and hence cigarettes of improved filling power are produced.

In the present invention, a tobacco feed is distributed by a distribution system in timed sequence to tobacco reservoirs from which tobacco is metered to cigarette-making machine feeds in accordance with the tobacco requirements of such machines.

Figure 1:
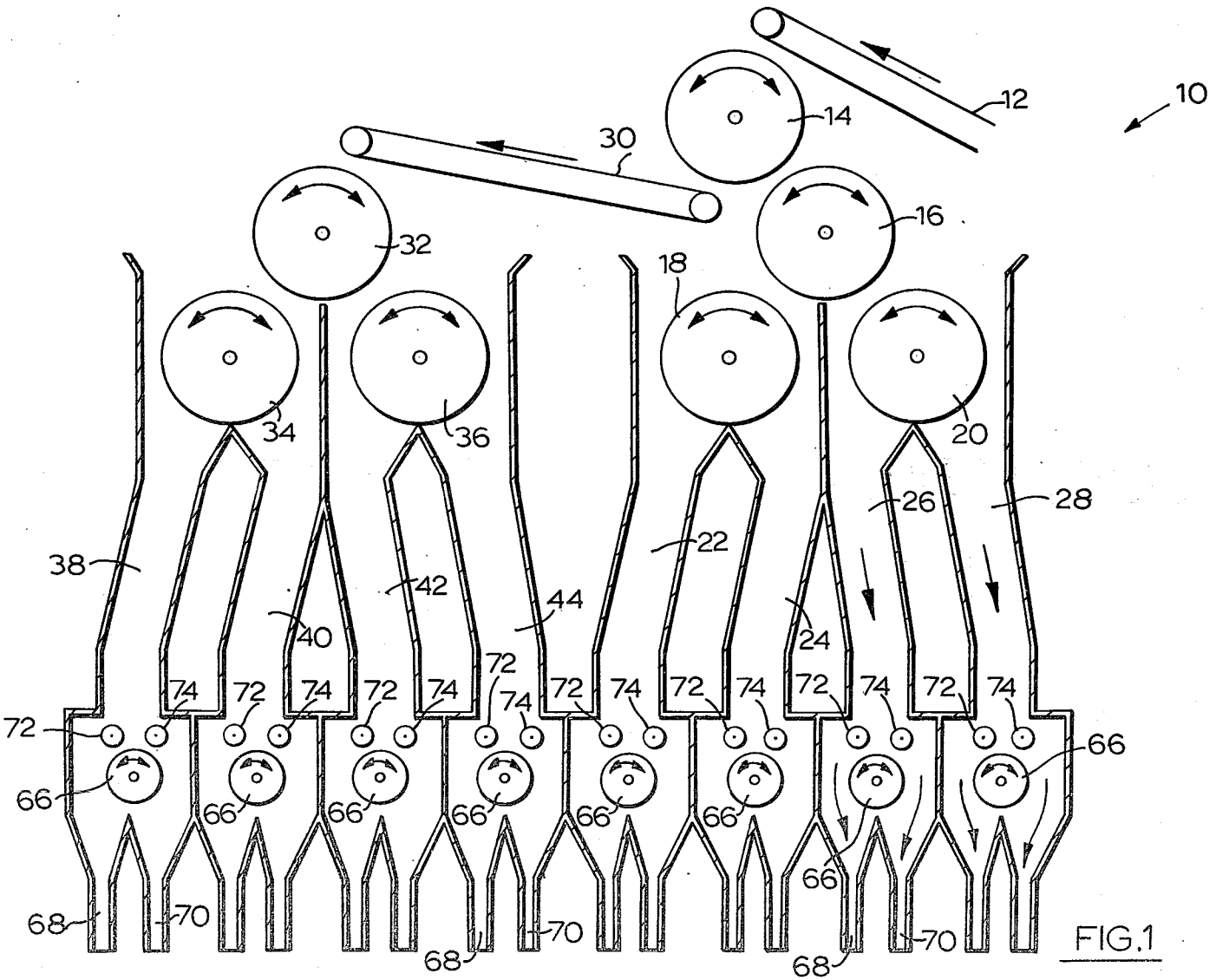
FIG. 1 is an elevational schematic view of one embodiment of the invention wherein tobacco from a source thereof is fed to sixteen cigarette-making machines.

Referring first to FIG. 1, a tobacco feed system or feeder table 10 includes a first conveyor 12 inclined upwardly from a source of tobacco, or other convenient tobacco mat conveying means, such as a drum and carrying a broad band of tobacco on the surface thereof. The tobacco conveyed on the surface of the conveyor 12 consists of tobacco particles which are interwoven to form a coherent mat or braid and fines loosely associated with the mat.

The tobacco falls from the end of the conveyor 12 onto the surface of a drum 14 mounted for driven rotation in either direction about a horizontally-oriented axis which is generally parallel to the plane of the surface of the conveyor 12.

With the drum 14 rotating in a clockwise direction, the tobacco received on the drum surface from the conveyor 12 is transported thereon and falls onto the outer surface of a second drum 16 mounted for driven rotation in either direction about a horizontally-oriented axis which is parallel to the axis of the drum 14.

With the second drum 16 rotating in an anticlockwise direction, the tobacco received on the surface thereof from drum 14 is transported thereon and falls onto the outer surface of a third drum 18.

The third drum 18 is mounted for driven rotation in either direction about a horizontally-oriented axis which is parallel to the rotational axes of the first and second drums 14 and 16.

With the drum 16 rotating in a clockwise direction, the tobacco received on the surface thereof from drum 14 is transported thereon and falls onto the outer surface of a fourth drum 20.

The fourth drum 20 is mounted for driven rotation in either direction about a horizontally-oriented axis which is parallel to the rotational axes of the first, second and third drums 14, 16 and 18.

Each of the drums 14, 16, 18 and 20 is constructed of light gauge metal and is of low inertia construction to allow rapid switching of the direction of rotation thereof, by suitable control means, not shown.

The third and fourth drums 18 and 20 are located one each at the upper end of a pair of parallel upright tobacco reservoir pipes or hoppers 22, 24 and 26, 28 respectively. With drum 18 rotating in an anticlockwise direction, the tobacco received thereon from drum 16 is conveyed thereon and dropped into reservoir pipe 22 whereas with drum 18 rotating in a clockwise direction, the tobacco received thereon from drum 16 is conveyed thereon and dropped into reservoir pipe 24.

Similarly, with drum 20 rotating in an anticlockwise direction, the tobacco received from the drum 16 is directed into reservoir pipe 26 and with drum 20 rotating in a clockwise direction, the tobacco received from the drum 16 is directed into reservoir pipe 28.

Thus, depending on the direction of rotation of drum 16 and the direction of rotation of drum 18 or 20, tobacco received on the surface of the drum 16 may be directed into any desired one of the reservoir pipes 22, 24, 26 and 28.

If desired, the drums 14, 16, 18 and 20, and any additional desired drums, may be arranged in an inclined straight line and individually arranged to feed a reservoir.

With drum 14 rotating in the anticlockwise direction, no tobacco is fed to the drum 16 but rather it is fed to the upper conveying surface of a second conveyor 30.

The tobacco transported by conveyor 30 is dropped onto the outer surface of a fifth drum 32 mounted for driven rotation in either direction about a horizontally-oriented axis which is parallel to the axis of the drum 14.

The fifth drum 32 constitutes an analogous drum to drum 14 for feed to a second group of four reservoirs.

Since each reservoir feeds tobacco to two cigarette making machines, the apparatus of FIG. 1 may be used to feed tobacco to sixteen cigarette makers.

The tobacco distribution mechanism for tobacco from the fifth drum 32 includes sixth and seventh drums 34 and 36 analogous to third and fourth drums 18 and 20 and tobacco reservoir pipes 38, 40, 42 and 44 analogous to reservoir pipes 22, 24, 26 and 28.

The drums 14, 16, 18, 20, 32, 34 and 36 each is identically constructed and has the same diameter. Each of the drums is constructed of light gauge metal and is of low inertia construction to allow rapid switching of the direction of rotation thereof by suitable control means, not shown. As may be seen from FIG. 4, which illustrates drums 32, 34 and 36, the drums are hollow and have a plurality of elongate depressions or pockets 46 located in the outer surface and defined by radially extending walls 48 and arcuately-extending webs 50 for transportation of tobacco on the drum surface. The depressions 46 are equally circumferentially spaced from each other and are closed at each end by annular walls 51.

In order to prevent tobacco, especially fines, from being misdirected and accumulated in a reservoir to which it is not desired to convey tobacco, a pair of left-hand baffles 52 and right-hand baffles 54 is provided adjacent the periphery of each of the drums. The baffles 52 and 54 are sprung forwardly from the rear by spring elements 56 allowing tobacco to pass one of the pair of baffles 52 and 54 when the adjacent drum is rotating in one direction while preventing tobacco from passing the other of the pairs of baffles 52 and 54.

For example, considering drum 32, rotating in the clockwise direction to direct tobacco onto drum 36, tobacco in the depressions 46 are conveyed past the right-hand baffle 54, the webs 48 and tobacco in the depressions biasing the baffle 54. Meanwhile, any fines or other tobacco particles are unable to pass the left-hand baffle 52 and become misdirected to the drum 34.

Similarly, with drum 36 rotating in a clockwise direction and receiving tobacco from the drum 32, tobacco in the depression 46 is conveyed past the right-hand baffle 54 for passage to the reservoir 44 where the tobacco is required, while fines and other tobacco particles cannot pass the left-hand baffle 52 for passage to the reservoir 42 where the tobacco is not required.

On the other hand, with drum 36 rotating in an anticlockwise direction, the tobacco in the depression 46 is conveyed past the left-hand baffle 52 and into reservoir 42 where the tobacco is required while tobacco is prevented by the right-hand baffle 54 from passing to the reservoir 44.

Figure 4:
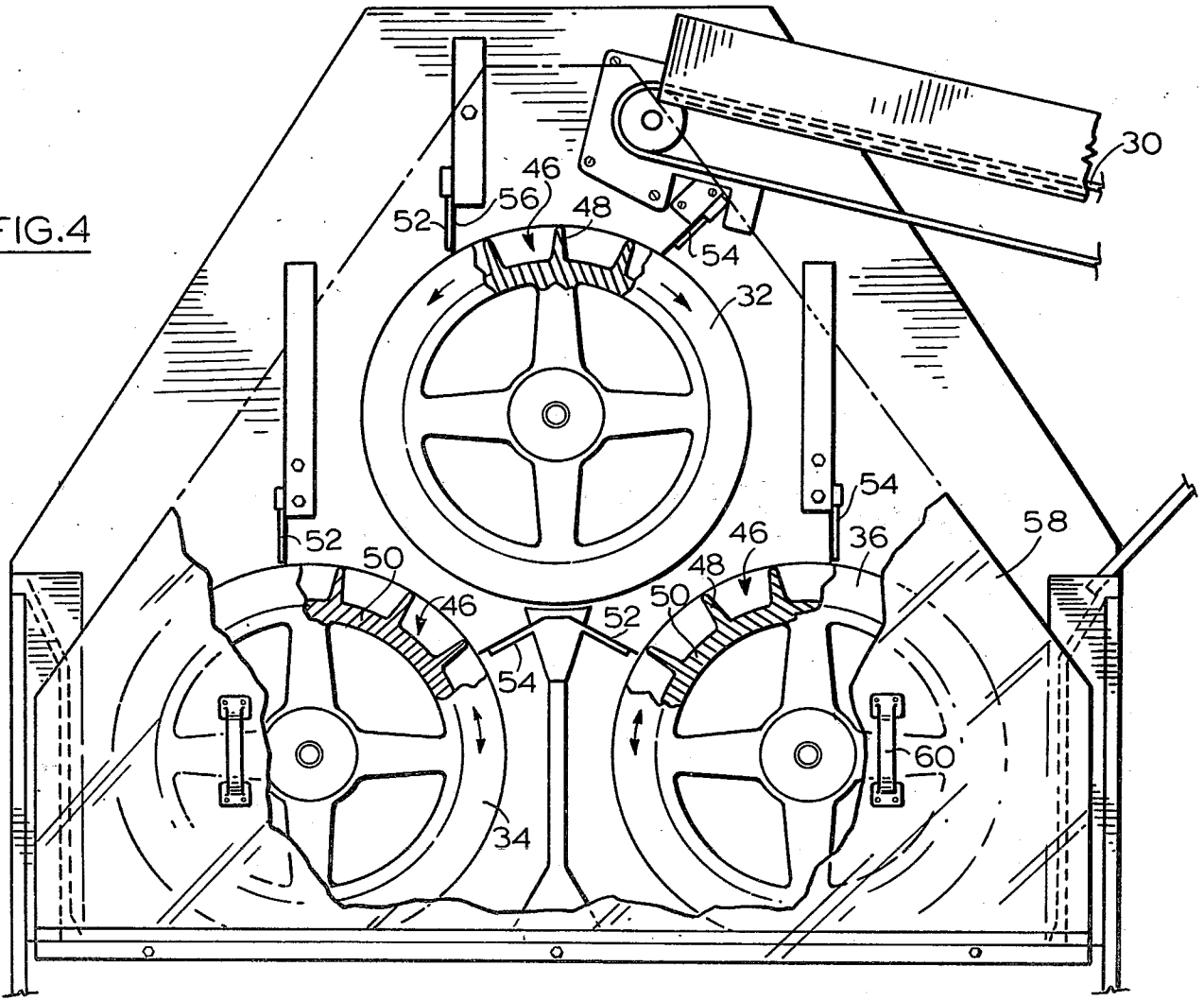
FIG. 4 is an elevational view, with parts cut away and partly in section of the upper tobacco distribution arrangement at the left-hand side of the apparatus shown in FIG. 1.

A transparent cover 58 with removing grips or handles 60 is provided to enable the operation of the unit illustrated in FIG. 4 to be observed for the ready detection of any breakdown. To prevent the egress of tobacco dust from the unit, a slight vacuum may be maintained within the housing.

The arrangement of the drums 32, 34 and 36 and the similar arrangement of the drums 16, 18 and 24 constitutes a tobacco distribution system which enables tobacco fed to the system to be distributed to a selected one of a plurality of reservoir pipes or hoppers.

Figure 2:
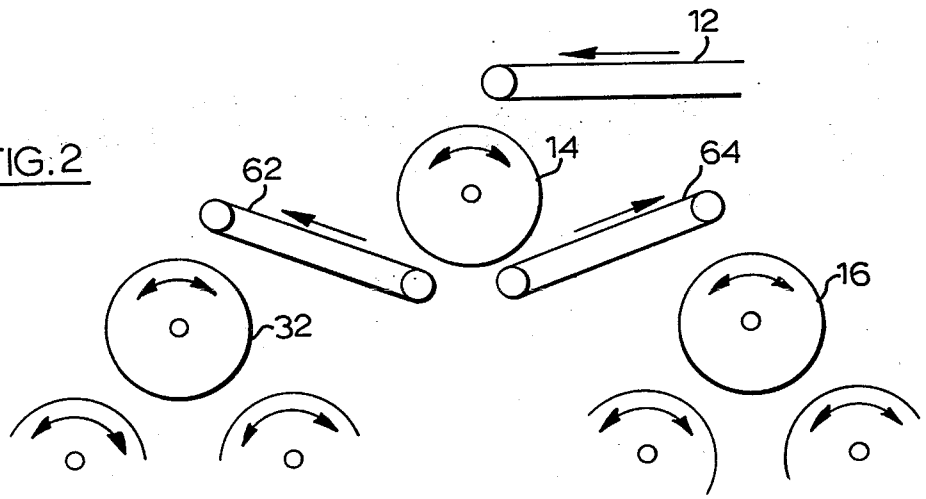
FIG. 2 is an elevational schematic view of a modification of the upper portion of the apparatus illustrated in FIG. 1.

The distribution system of the sets of three drums are operatively interconnected with respect to tobacco feed by the drum 14 and the conveyor 30. In FIG. 2 an alternative arrangement is illustrated, in which the distribution systems are joined by drum 14 centrally located between the drum sets and two conveyor belts 62 and 64 which respectively feed tobacco received from drum 14 to drum 32 and drum 16. If desired, the conveyor belts 62 and 64 may be replaced by rotating drums.

Tobacco fed to the apparatus 10 by the conveyor 12 is directed to one of eight tobacco reservoirs, the particular one depending on the direction of rotation of the various drums. The tobacco which flows from the source to the apparatus 10 by conveyor 12 at any given time passes intact into one or other of the reservoirs.

In this way, classification of particle sizes of the tobacco in the feed cannot occur and recycle of tobacco to the source is unnecessary, thereby retaining the filling power and the uniformity of the original tobacco feed, in contrast to the prior art systems described above.

The choice of reservoir to which tobacco is to be fed at any given time depends on individual cigarette-making machine requirements. Tobacco is metered from the lower end of each reservoir or hopper into a feed pipe which feeds an individual cigarette-making machine.

Located adjacent the lower end of each reservoir pipe 22, 24, 26, 28, 38, 40, 42 and 44 is a drum 66 which is mounted for driven rotation on its axis in either direction to direct tobacco from the respective feed hopper to one or the other of two feed lines 68, 70 for two cigarette-making machines (not shown).

Located between the reservoir pipe and the drum 66 are tobacco metering drums 72 and 74 mounted for rotation about a horizontal axis parallel to the axis of rotation of the drum 66 with drum 72 rotating in a clockwise direction and drum 74 rotating in an anticlockwise direction.

The drums 66, 72 and 74 constitute a tobacco metering system for the metering of tobacco as required from a hopper containing tobacco to one of two cigarette-making machine feeds. The metering system is shown in more detail in FIGS. 5 and 6.

The drum 66 has a plurality of radial pins 76 projecting from the outer surface and arranged in arcuately-spaced rows. Annular end walls 77 are provided to prevent tobacco from being dislodged from the drum 66. Each of the metering drums 72 and 74 has a plurality of radial pins 78 projecting from the outer surface and arranged in arcuately-spaced rows.

Figure 5:
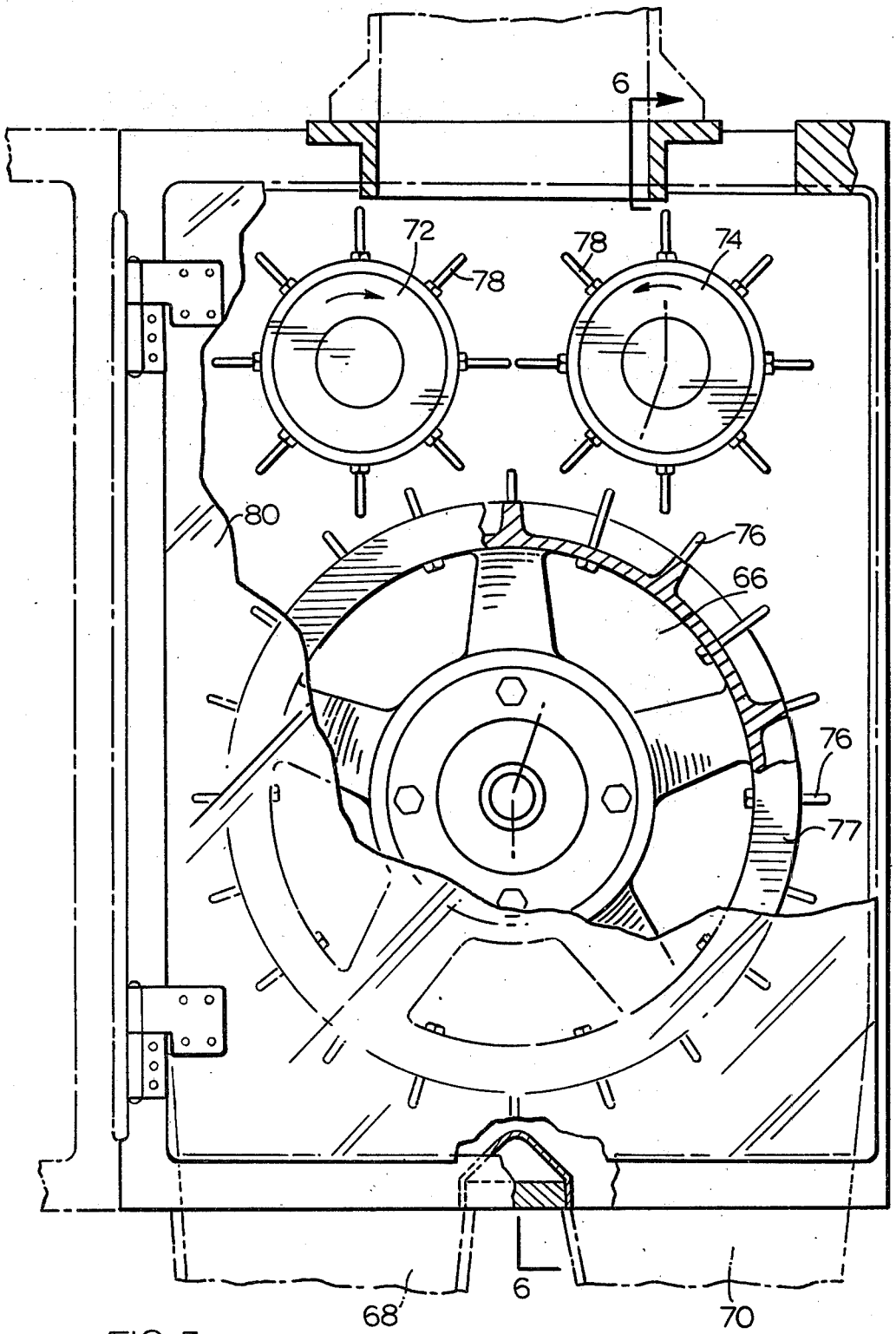
FIG. 5 is an elevational view, with parts cut away and partly in section of the tobacco metering arrangement at the lower end of one of the hoppers in the apparatus of FIG. 1.
Figure 6:
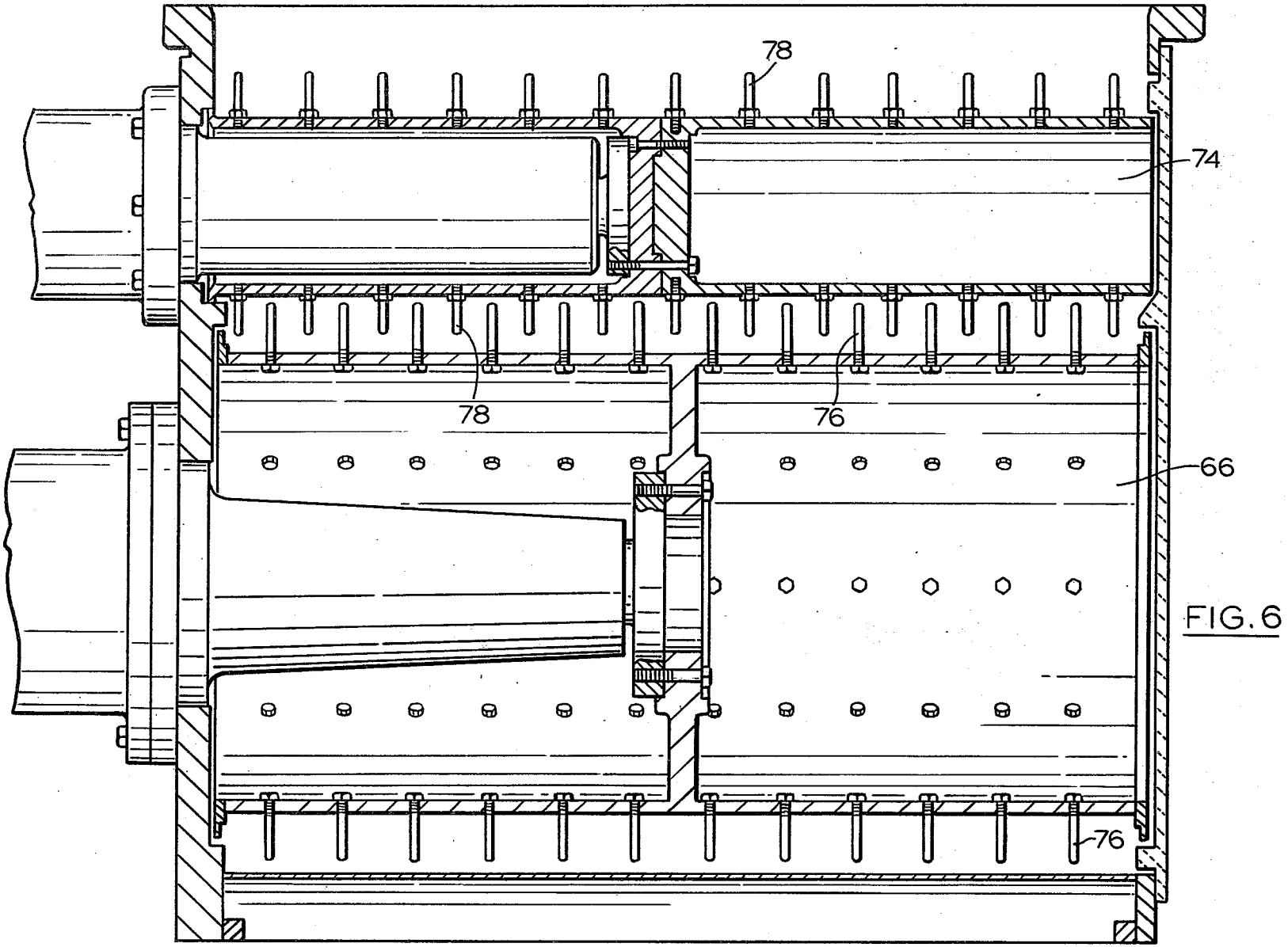
FIG. 6 is a sectional view taken on line 6—6 of FIG. 5.

The radial pins 76 on the drum 66 and the radial pins 78 on the drums 72 and 74 overlap, as may be seen in FIG. 5 and are interleaved, as may be seen in FIG. 6. The radial pins 78 on the respective drums 72 and 74 are arranged to project towards each other at the point of closest approach to each other but not to overlap as may be seen in FIG. 5.

The drums 72 and 74 meter tobacco from the bulk contained in the reservoir by the cooperative action of the radial pins 78 towards the drum 66. The drum 66 then directs the metered tobacco into the selected one of the cigarette-making machine feed pipes 68 and 70 under the cooperative action of the radial pins 76 and 78, the overlapping of the pins ensuring a positive displacement of metered tobacco. The radial pins 76 and to some extent the overlapping radial pins 78 open up the metered tobacco.

A hinged transparent cover 80 is provided on the front of the metering system to observe any malfunction of the unit.

At any given time, the tobacco is fed to one only of the individual cigarette-making machine feed lines, so that feed splitting, with consequential classification, and recycling also is avoided in this region of this system. The metering system may be used to feed a single machine, if desired.

Where it is desired to feed just eight cigarette makers from a single tobacco source, drum 14, conveyor 30 and drum 32 and its associated components may be omitted and the conveyor 12 is arranged to drop tobacco on the drum 16.

Figure 3:
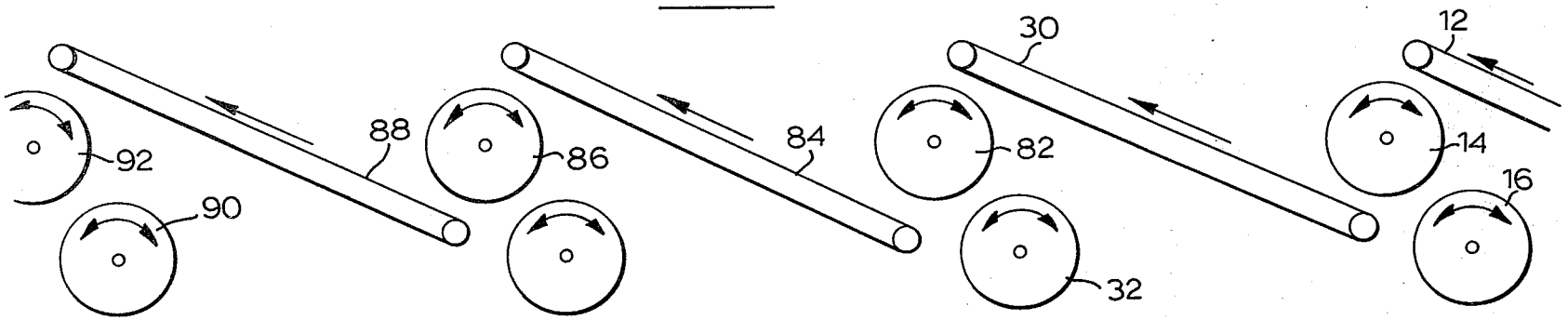
FIG. 3 is an elevational schematic view of the upper portion of another embodiment of the invention in which tobacco from a source thereof is fed to thirty-two cigarette-making machines.

The embodiment of FIG. 3 illustrates the application of the present invention to the feed of thirty-two cigarette-making machines from a single tobacco source. The system involved is very similar to that outlined above with respect to the embodiment of FIG. 1, with the addition of further components. The lower portion of the apparatus is identical to that illustrated in FIG. 1, except that two groups of 16 cigarette makers are fed in place of the single group of 16 cigarette makers. Conveyor 30 drops tobacco onto a further drum 82 mounted for driven rotation in either direction about an axis parallel to the axis of drum 14.

With drum 82 rotating in a clockwise direction, tobacco is deposited on drum 32 while with drum 82 rotating in an anticlockwise direction, tobacco is deposited on a conveyor. Conveyor 84 drops conveyed tobacco onto another drum 86 mounted from driven rotation in either direction about an axis parallel to the axis of drum 14.

Drum 86 is analogous to a drum 14 and a conveyor 88 is provided analogous to conveyor 30 for receiving and conveying the tobacco when drum 86 rotates in an anticlockwise direction. A drum 90 is analogous to drum 32 to receive tobacco directly from the conveyor 88, or indirectly, as illustrated, via a drum 92.

An additional conveyor analogous to conveyor 88 associated with drum 92 may be provided if it is desired that the single source feed additional banks of cigarette-making machines.

The apparatus of FIG. 3 operates in analogous manner to the apparatus of FIG. 1 described above, suitably modified by the additional conveyors and drums.

The tobacco feeding system 10, therefore, comprises a tobacco distribution system and a tobacco metering system which are joined by reservoirs or hoppers. The system allows the feed of tobacco from a single source to a plurality of cigarette-making machines in accordance with the requirements of those machines, without the necessity to recycle tobacco to the source, abruptly change tobacco direction or to separate increments of tobacco one from another, in contrast to the prior art.

When tobacco is required by an individual machine, the metering system associated with a particular reservoir feeds tobacco to the machine until the tobacco storage hopper of the machine is filled and no further quantities of tobacco are required. If the other machine fed by the same reservoir and metering system then requires tobacco, the metering system switches feed to the appropriate feed pipe. If the other machine, however, does not require tobacco, then the metering system switches off. This metering operation occurs simultaneously at each metering system of the unit and flow of tobacco from the individual reservoirs simultaneously occurs in accordance with the individual cigarette-making machine requirements.

As the level of tobacco falls in the individual reservoirs in accordance with the metered feed to the cigarette-making machines, tobacco in the reservoirs is replenished from the feed by appropriate operation of the distribution system. The reservoirs of tobacco permits tobacco to be fed to eight machines at one time while tobacco sequentially is fed from the feed to the reservoirs to replenish the same.

Where one or more machines is inoperable, the overall quantity of tobacco required to be fed to the system is less than when all the machines are operable and this variation may be accommodated by decreasing the feed rate of tobacco to the system or by ceasing to feed tobacco from time to time when all the reservoirs are full.

It will be seen, therefore, that the present invention provides a novel tobacco feeding system which is superior to the prior art systems discussed above. Modifications are possible within the scope of the invention.

What we claim is:

1. An apparatus for feeding of tobacco from a source thereof to a plurality of individual cigarette-making machine feeds, which comprises:

a plurality of upwardly projecting reservoirs open at the top and bottom thereof and having enclosing side walls, tobacco metering means located at the lower end of each of said reservoirs for metering tobacco from said reservoir to one or a selected one of two of said individual feeds, and distribution means located between the downstream end of a conveyor means extending from said source and the upper end of said reservoirs for feeding all the tobacco fed to the apparatus by said conveyor means to one or another of said reservoirs, said metering means comprising first and second rollers mounted for rotation about parallel horizontal axes in opposite directions to direct tobacco downwardly between their opposed surfaces, each of said first and second rollers having a plurality of radially projecting pins located in arcuately spaced rows, and a third roller mounted below said first and second rollers for rotation in either direction about a horizontal axis parallel to the axes of the first and second rollers, the third roller having a plurality of radially-projecting pins located in arcuately spaced rows, the axis of the third roller lying on a straight line perpendicular to the line joining the axes of the first and second rollers.

2. The apparatus of claim 1, wherein the radial pins of said third roller interleave with those of the first and second rollers at their points of closest approach.

3. The apparatus of claim 1, wherein said distribution means comprises first and second drum means mounted for rotation in either direction about parallel horizontal axes at the upper ends of four such reservoirs for respective selective feeding of tobacco to one of two of said reservoirs, and a third drum means mounted above said first and second drum means for rotation in either direction about a horizontal axis parallel to the axes of said first and second drum means, the axis of said third drum means lying on a straight line perpendicular to the line joining the axes of said first and second drums.

4. The apparatus of claim 3, wherein each said drum means has a plurality of circumferentially-spaced depressions in the surface thereof for conveying tobacco on the surface thereof.

5. The apparatus of claim 4, including resiliently displaceable baffle means located adjacent the periphery of each of said drum means allowing passage of tobacco to the selected one of said two reservoirs and preventing passage of tobacco to either one of said two reservoirs at other times.

6. The apparatus of claim 1, including two sets of said first, second and third drum means associated with eight said reservoirs, the axes of the first and second drum means in each set lying on a common straight line, and including means selectively feeding tobacco at a given time from said feed to one or the other of said drum sets.

7. The apparatus of claim 6, wherein said selective feeding means comprises a further drum means mounted above one of said drum sets for rotation in either direction about a horizontal axis parallel to the axes of said drum means in said sets to receive tobacco directly from said conveyor means and a further conveyor means extending between said further drum means and the third drum means of the other drum set.

* * * * *